US012607420B2

(12) United States Patent
Zhong et al.

(10) Patent No.: US 12,607,420 B2
(45) Date of Patent: Apr. 21, 2026

(54) THREE-CHANNEL HEAT SINK BASED ON TRI-CONTINUOUS MESOPOROUS SILICA STRUCTURE AND PREPARATION METHOD FOR THREE-CHANNEL HEAT SINK

(71) Applicant: SHANGHAI JIAO TONG UNIVERSITY, Shanghai (CN)

(72) Inventors: Haozhang Zhong, Shanghai (CN); Jiaxuan Wang, Shanghai (CN); Chenyi Qian, Shanghai (CN); Binbin Yu, Shanghai (CN); Jiangping Chen, Shanghai (CN); Chuanwei Li, Shanghai (CN); Jianfeng Gu, Shanghai (CN)

(73) Assignee: SHANGHAI JIAO TONG UNIVERSITY, Shanghai (CN)

( * ) Notice: Subject to any disclaimer, the term of this patent is extended or adjusted under 35 U.S.C. 154(b) by 81 days.

(21) Appl. No.: 18/661,859

(22) Filed: May 13, 2024

(65) Prior Publication Data

US 2025/0297817 A1 Sep. 25, 2025

(30) Foreign Application Priority Data

Mar. 20, 2024 (CN) ..... 202410323242.8

(51) Int. Cl.
*F28F 21/04* (2006.01)
*F28F 7/02* (2006.01)
*F28F 13/00* (2006.01)

(52) U.S. Cl.
CPC ..... *F28F 13/003* (2013.01); *F28F 7/02* (2013.01); *F28F 21/04* (2013.01)

(58) Field of Classification Search
CPC . B33Y 80/00; F28F 7/02; F28F 13/003; F28F 21/04; G06F 30/17; H05K 7/2029; H05K 7/2039
See application file for complete search history.

(56) References Cited

U.S. PATENT DOCUMENTS 4,041,592 A * 8/1977 Kelm ..... F28F 21/04 428/117
10,955,200 B2 * 3/2021 Sabo ..... F28F 7/02
2004/0031592 A1 * 2/2004 Mathias ..... F16L 41/02 165/104.19

(Continued)

*Primary Examiner* — Eric S Ruppert
*Assistant Examiner* — Hans R Weiland
(74) *Attorney, Agent, or Firm* — Leber IP Law; Faustino Lichauco

(57) ABSTRACT

Provided is a three-channel heat sink based on a tri-continuous mesoporous silica structure. including multiple three-channel porous units stacked on one another. Each of the three-channel porous units includes three channels which do not communicate with one another, each of the channels includes at least one flow path. Each of the three-channel porous units includes five flow paths, the five flow paths are arranged in two layers in a vertical direction. When viewed in the vertical direction, four of the five flow paths are enclosed to form a parallelogram pattern, and the fifth flow path is located at a diagonal position of the parallelogram pattern to independently form a third channel. A body formed by the plurality of three-channel porous units stacked on one another is internally provided with three medium flow paths which intersect, contact and do not communicate with one another.

9 Claims, 12 Drawing Sheets

(56) References Cited

U.S. PATENT DOCUMENTS

| | | | | |
|---|---|---|---|---|
| 2016/0116218 | A1* | 4/2016 | Shedd | F28F 21/06 165/182 |
| 2016/0202003 | A1* | 7/2016 | Gerstler | F28D 9/00 |
| 2017/0367218 | A1* | 12/2017 | Gerstler | F28D 9/0093 |
| 2018/0306516 | A1* | 10/2018 | Miller | F28F 7/02 |
| 2020/0016704 | A1* | 1/2020 | Stewart, Jr. | B23P 15/26 |
| 2022/0412668 | A1* | 12/2022 | Strange | B23P 15/26 |
| 2023/0314087 | A1* | 10/2023 | Kurosawa | F28F 3/025 165/164 |

* cited by examiner

THREE-CHANNEL HEAT SINK BASED ON TRI-CONTINUOUS MESOPOROUS SILICA STRUCTURE AND PREPARATION METHOD FOR THREE-CHANNEL HEAT SINK

CROSS-REFERENCE TO RELATED APPLICATION

This patent application claims the benefit and priority of Chinese Patent Application No. 202410323242.8 filed with the China National Intellectual Property Administration on Mar. 20, 2024, the disclosure of which is incorporated by reference herein in its entirety as part of the present application.

TECHNICAL FIELD

The present disclosure relates to the field of heat sink manufacturing, and in particular to a 3D-printed three-channel heat sink based on a tri-continuous mesoporous silica structure, and a preparation method for the three-channel heat sink.

BACKGROUND

With the development of technology and the improvement of productivity, the high-tech products, such as new energy vehicles, are increasingly widely used. For example, one of the remarkable characteristics of the high-tech products, such as new energy vehicles, is high integration, which requires to install a large number of components in a limited space, and the heat sink is one of the indispensable components. The heat dissipation effect of the traditional heat sink is related to its own size. Specifically, the larger the size of the heat sink, the better the heat dissipation effect, but when the size of the heat sink is limited in a limited space, the heat dissipation effect will be poor. Therefore, there is an urgent need for a compact and efficient heat sink. In the microscopic field, tri-continuous mesoporous silica is of a compact structure with three channels contacting with one another. However, currently, this tri-continuous mesoporous silica structure is only applied in the microscopic field, but not in the macroscopic environment.

SUMMARY

An objective of the present disclosure is to provide a three-channel heat sink based on a tri-continuous mesoporous silica structure, so as to solve the problems in the prior art. A novel heat sink different from the prior art is designed based on the tri-continuous mesoporous silica structure. Three flow paths in the heat sink provided by the present disclosure are in contact in pairs, and the flow velocity of a cold medium used for heat exchange is large, and the heat exchange efficiency of the cold and hot media is high.

A preparation method for a three-channel heat sink based on a tri-continuous mesoporous silica structure is further provided by the present disclosure, so as to prepare the three-channel heat sink based on a tri-continuous mesoporous silica structure.

To achieve the objective above, the present disclosure employs the following technical solution:

A three-channel heat sink based on a tri-continuous mesoporous silica structure includes a plurality of three-channel porous units stacked on one another. Each of the three-channel porous units includes three channels which do not communicate with one another, each of the channels includes at least one flow path, and the flow path includes an upper horizontal section, a vertical section, and a lower horizontal section; an outlet end of the upper horizontal section is connected to an inlet end of the vertical section, an outlet end of the vertical section is connected to an inlet end of the lower horizontal section, and the upper horizontal section, the vertical section and the lower horizontal section form a Z-shaped structure.

Each of the three-channel porous units includes five flow paths, the five flow paths are arranged in two layers in a vertical direction, and the upper horizontal section and the lower horizontal section of each of the five flow paths are located in an upper layer and a lower layer in the vertical direction, respectively.

When viewed in the vertical direction, four of the five flow paths are enclosed to form a parallelogram pattern. In the upper layer, upper horizontal sections of two adjacent flow paths intersect and communicate with each other to form a first channel and in the lower layer, lower horizontal sections of the two adjacent flow paths intersect and communicate with each other to form a second channel; and a remaining one of the five flow paths is located at a diagonal position of the parallelogram pattern to independently form a third channel.

A body formed by the plurality of three-channel porous units stacked on one another is internally provided with three medium flow paths which intersect, contact and do not communicate with one another.

Preferably, in a same layer in the vertical direction, the plurality of three-channel porous units are sequentially aligned and arranged to form a heat dissipation layer, and adjacent three-channel porous units share one flow path.

Preferably, in a same horizontal plane, a joint where upper horizontal sections of one of the three-channel porous units intersect and communicate with one another is externally connected with an outlet end of the third channel of an other of the three-channel porous units.

Preferably, in the same horizontal plane, a joint where lower horizontal sections of one of the three-channel porous units intersect and communicate with one another is externally connected with an inlet end of the third channel of another three-channel porous unit.

Preferably, in a same layer in the vertical direction, second channels, third channels and first channels of three of the three-channel porous units are sequentially connected to form a first medium flow path unit, and a plurality of first medium flow path units are in communication with one another to form a first medium flow path.

Preferably, in a same layer in the vertical direction, first channels, third channels and second channels of three of the three-channel porous units are sequentially connected to form a second medium flow path unit, and a plurality of second medium flow path units are in communication with one another to form a second medium flow path.

Preferably, in a same layer in the vertical direction, third channels of three of the three-channel porous units are respectively connected to first channels or second channels of the three of the three-channel porous units in sequence to form a third medium flow path unit, and a plurality of third medium flow path units are in communication with one another to form a third medium flow path.

Preferably, a plurality of heat dissipation layers are stacked in the vertical direction to form the three-channel heat sink, vertical sections corresponding to positions between adjacent heat dissipation layers communicate with each other, and the three-channel heat sink is of a hexahedral structure.

Preferably, a heat sink housing is arranged outside the three-channel heat sink, three medium inlets and three medium outlets are formed in the heat sink housing, and both ends of each of the first medium flow path, the second medium flow path and the third medium flow path are provided with one of the three medium inlets and one of the three medium outlets, respectively.

A preparation method for a three-channel heat sink based on a tri-continuous mesoporous silica structure is further provided by the present disclosure, including the following steps:

Step one, drawing a minimum symmetric primitive in drawing software, and sequentially performing 180-degree rotation, circumferential array and mirror symmetry operations on the minimum symmetric primitive to obtain a three-channel porous unit;

Step two, stacking three-channel porous units in the drawing software to form a three-channel heat sink, wherein the three-channel heat sink is formed by stacking the three-channel porous units in a three-dimensional space; and Step three, printing the three-channel heat sink by a 3D printer.

Compared with the prior art, the present disclosure has the following technical effects:

The three-channel heat sink based on the tri-continuous mesoporous silica structure of the present disclosure is formed by stacking multiple three-channel porous units, and the structure of the three-channel porous unit refers to a single-cell structure of the three-channel mesoporous silica. Compared with the prior art, there are three flow paths in the three-channel porous unit, such that two cold media can be introduced into the heat sink for heat exchange, and the three channels contact with each other, thus ensuring the heat exchange efficiency of cold and hot media. The heat sink of the present disclosure is compact in structure and high in heat exchange efficiency. At the same size parameter, the heat dissipation effect of the heat sink of the present disclosure far exceeds that of the heat sink in the prior art.

A preparation method for the three-channel heat sink based on the tri-continuous mesoporous silica structure is further provided, the additive manufacturing is carried out by a 3D printer, thus overcoming the problem that the existing machining technology is difficult to manufacture products with complex modeling surface.

BRIEF DESCRIPTION OF THE DRAWINGS

To describe the technical solutions of the embodiments of the present disclosure or in the prior art more clearly, the following briefly introduces the accompanying drawings required for describing the embodiments. Apparently, the accompanying drawings in the following description show merely some embodiments of the present disclosure, and those of ordinary skill in the art may still derive other drawings from these accompanying drawings without creative efforts.

Figure 1:
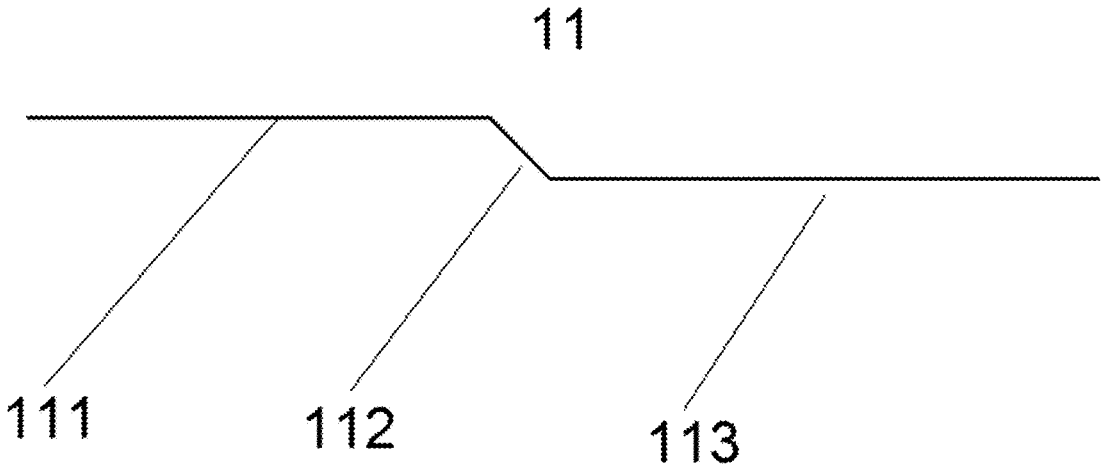
FIG. 1 is a structural schematic diagram of a single flow path according to an embodiment of the present disclosure.

In the drawings: 1 three-channel porous unit; 11 flow path; 111 upper horizontal section; 112 vertical section; 113 lower horizontal section;

21 first channel; 22 second channel; 23 third channel;

3 heat sink housing; 31 medium inlet; and 32 medium outlet.

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by a person of ordinary skill in the art based on the embodiments of the present disclosure without creative efforts shall fall within the scope of protection of the present disclosure.

An objective of the present disclosure is to provide a three-channel heat sink based on a tri-continuous mesoporous silica structure, so as to solve the problems in the prior art. A novel heat sink different from heat sinks in the prior art is designed based on the tri-continuous mesoporous silica structure. Three flow paths in the heat sink of the present disclosure contact with one another, wherein the flow velocity of a cold medium used for heat exchange is big, and the heat exchange efficiency of the cold and hot media is high.

In order to make the objectives, features and advantages of the present disclosure more clearly, the present disclosure is further described in detail below with reference to the embodiments.

As shown in FIG. 1 to FIG. 5, a three-channel heat sink based on a tri-continuous mesoporous silica structure includes multiple three-channel porous units 1 stacked on one another. Each of the three-channel porous units 1 includes three channels which do not communicate with one another, the three channels includes a first channel 21, a second channel 22, and a third channel 23, each channel includes at least one flow path 11, and the flow path 11 includes an upper horizontal section 111, a vertical section 112, and a lower horizontal section 113. An outlet end of the upper horizontal section 111 is connected to an inlet end of the vertical section 112, an outlet end of the vertical section 112 is connected to an inlet end of the lower horizontal section 113, and the upper horizontal section 111, the vertical section 112 and the lower horizontal section 113 of each flow path form a Z-shaped structure. The positions of upper and lower layers in the flow path 11 are not strictly limited, and can be overturned for use. The tri-continuous mesoporous silica structure may refer the disclosure "A tri-continuous mesoporous material with a silica pore wall following a hexagonal minimal surface", and the present disclosure applies the tri-continuous mesoporous silica structure to a macroscopic environment from the microscopic field.

Figure 3:
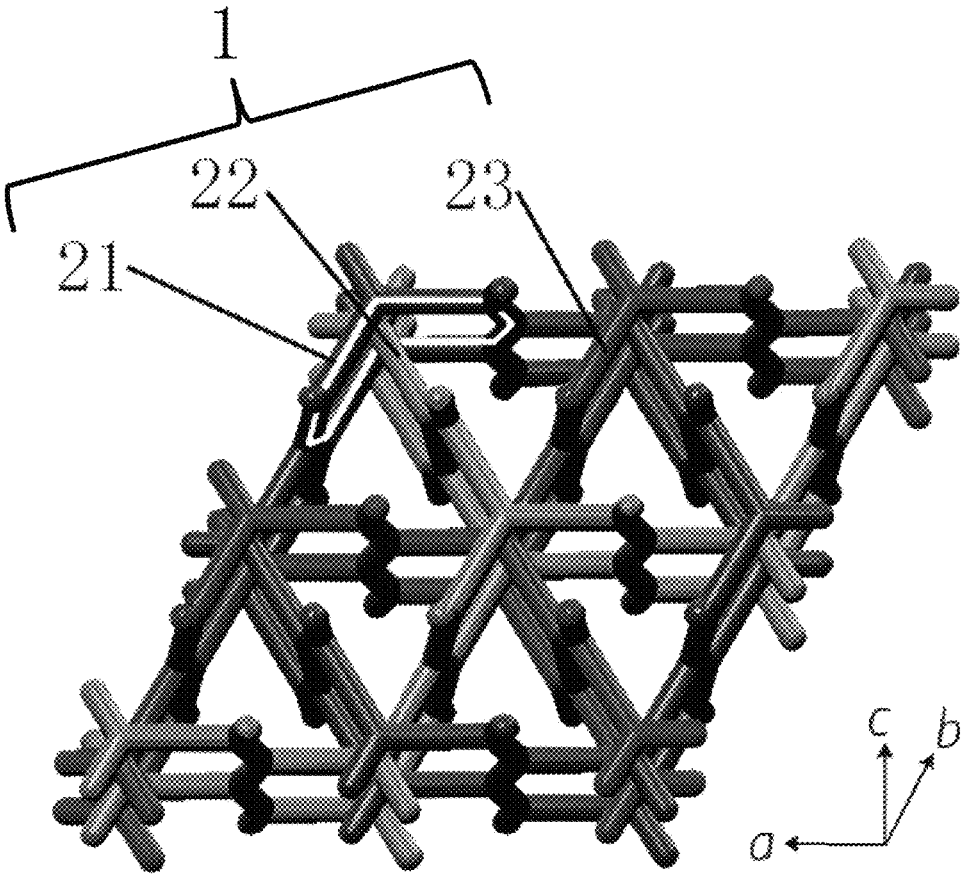
FIG. 3 is a structural schematic diagram of flow paths in the eight three-channel porous units stacked on one another in the form of 2×2×2 according to an embodiment of the present disclosure.

As shown in FIG. 3, each three-channel porous unit 1 includes five flow paths 11. The five flow paths are arranged in two layers in a vertical direction, and the upper horizontal section 111 and the lower horizontal section 113 of each flow path 11 are located in an upper layer and a lower layer in the vertical direction, respectively.

When viewed in the vertical direction, four of the five flow paths 11 are enclosed to form a quadrilateral structure, preferably a parallelogram pattern. In the upper layer, upper horizontal sections 111 of two adjacent flow paths 11 intersect and communicate with each other to form the first channel 21. In the lower layer, lower horizontal sections 113 of two adjacent flow paths 11 intersect and communicate with each other to form the second channel 22. A remaining one of the five flow path 11 is located at a diagonal position of the parallelogram pattern to independently form the third channel 23. When viewed in a horizontal direction, the three flow paths intersect and do not communicate with one another.

A body formed by the multiple three-channel porous units 1 stacked on one another is internally provided with three medium flow paths which intersect, contact and do not communicate with one another.

As shown in FIG. 3, in a same layer in the vertical direction, the multiple three-channel porous units 1 are sequentially aligned and arranged to form a heat dissipation layer. The adjacent three-channel porous units 1 share one flow path.

In a same horizontal plane, a joint where upper horizontal sections 111 of one of the three-channel porous units 1 intersect and communicate with one another is externally connected with an outlet end of the third channel 23 of another of the three-channel porous units. In a same horizontal plane, a joint where the lower horizontal sections 113 of one of the three-channel porous units 1 intersect and communicate with one another is externally connected with an inlet end of the third channel 23 of another of the three-channel porous units 1.

In a same layer in the vertical direction, second channels 22, third channels 23 and first channels 21 of three of the three-channel porous units 1 are sequentially connected to form a first medium flow path unit, and multiple first medium flow path units are in communication with one another to form a first medium flow path. In a same layer in the vertical direction, first channels 21, third channels 23 and second channels 22 of three of the three-channel porous units 1 are sequentially connected to form a second medium flow path unit, and multiple second medium flow path units are in communication with one another to form a second medium flow path. In a same layer in the vertical direction, third channels 23 of three of the three-channel porous units 1 are respectively connected to first channels 21 or second channels 22 of the three of the three-channel porous units 1 in sequence to form a third medium flow path unit, and multiple third medium flow path units are in communication with one another to form a third medium flow path.

Figure 2:
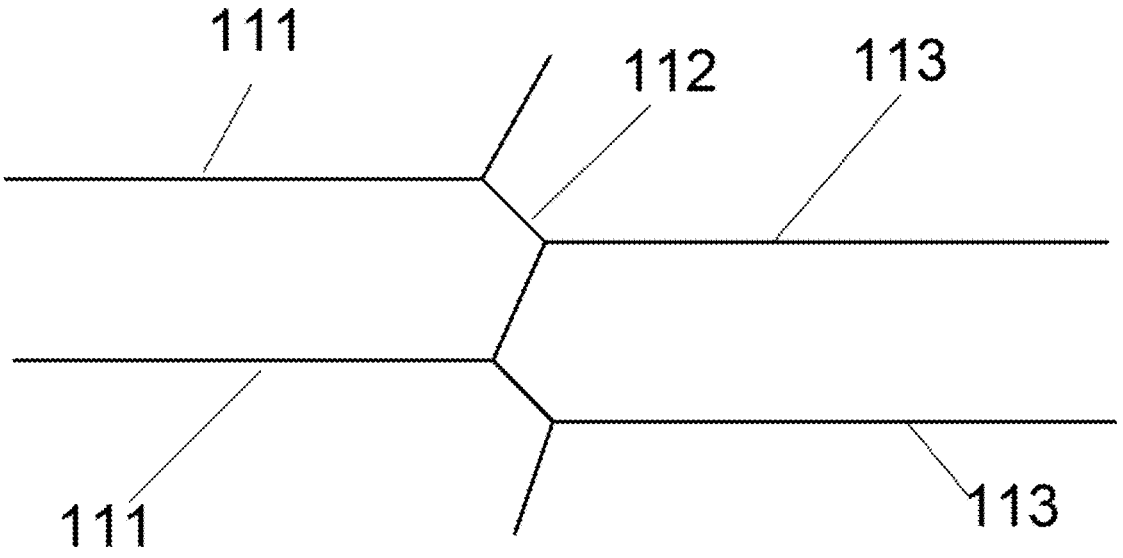
FIG. 2 is a structural schematic diagram of multiple flow paths connected to each other in a vertical direction according to an embodiment of the present disclosure.
Figure 5:
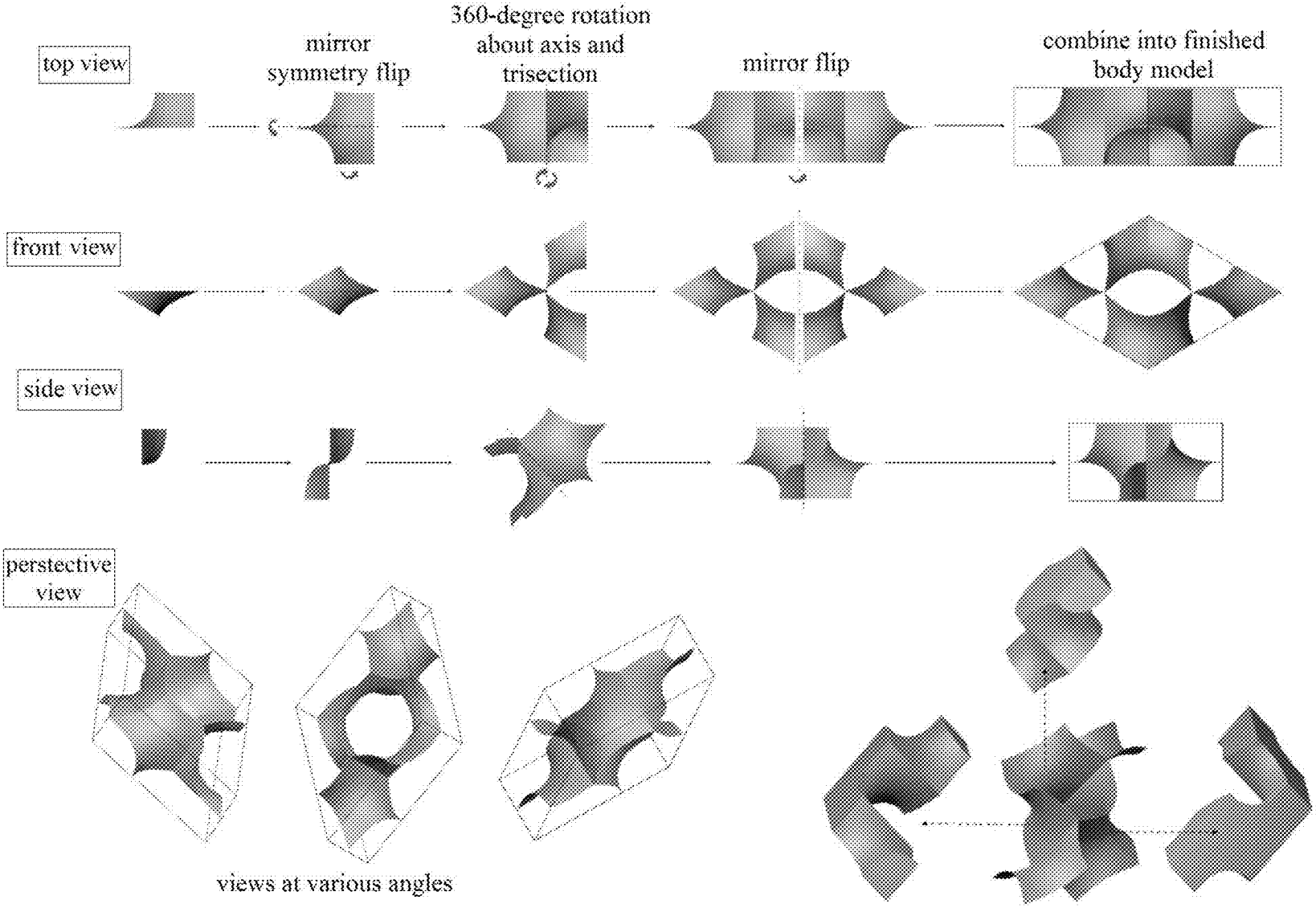
FIG. 5 shows a drawing process of a three-channel porous unit according to an embodiment of the present disclosure.

As shown in FIG. 5, the multiple heat dissipation layers are stacked in the vertical direction to form the three-channel heat sink. As shown in FIG. 2, the vertical sections 112 corresponding to positions between adjacent heat dissipation layers communicate with each other, and the three-channel heat sink is of a polyhedral structure, preferably a hexahedral structure.

Figure 6A:
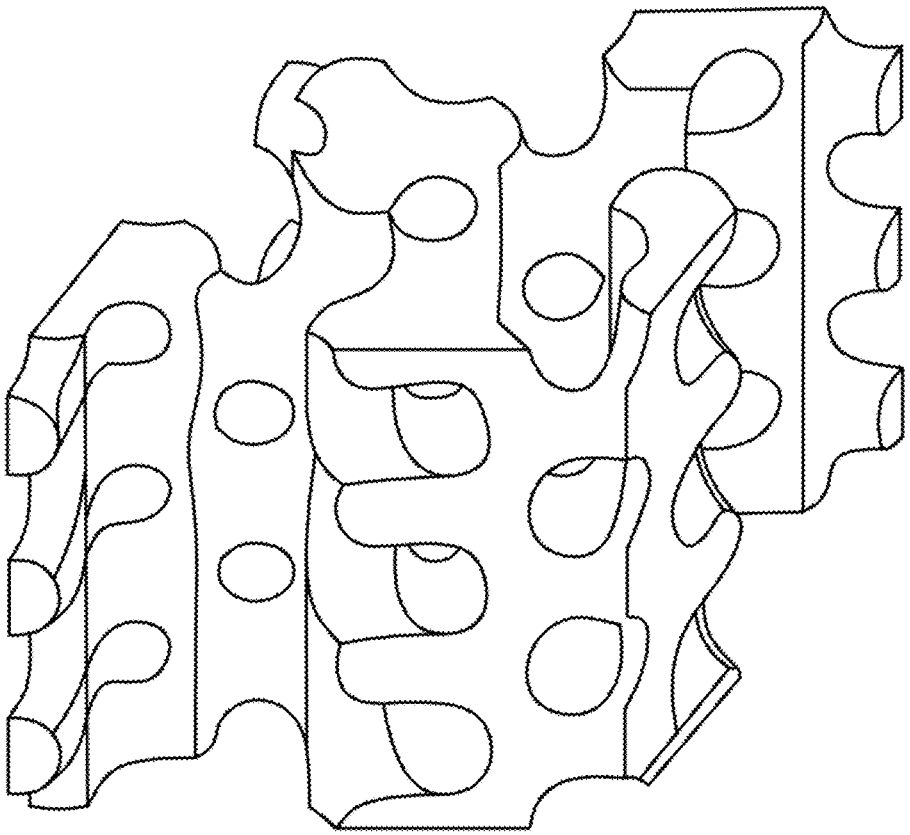
FIGS. 6A-6D are structural schematic diagrams of the three-channel heat sink drawn by drawing software according to an embodiment of the present disclosure.
Figure 6B:
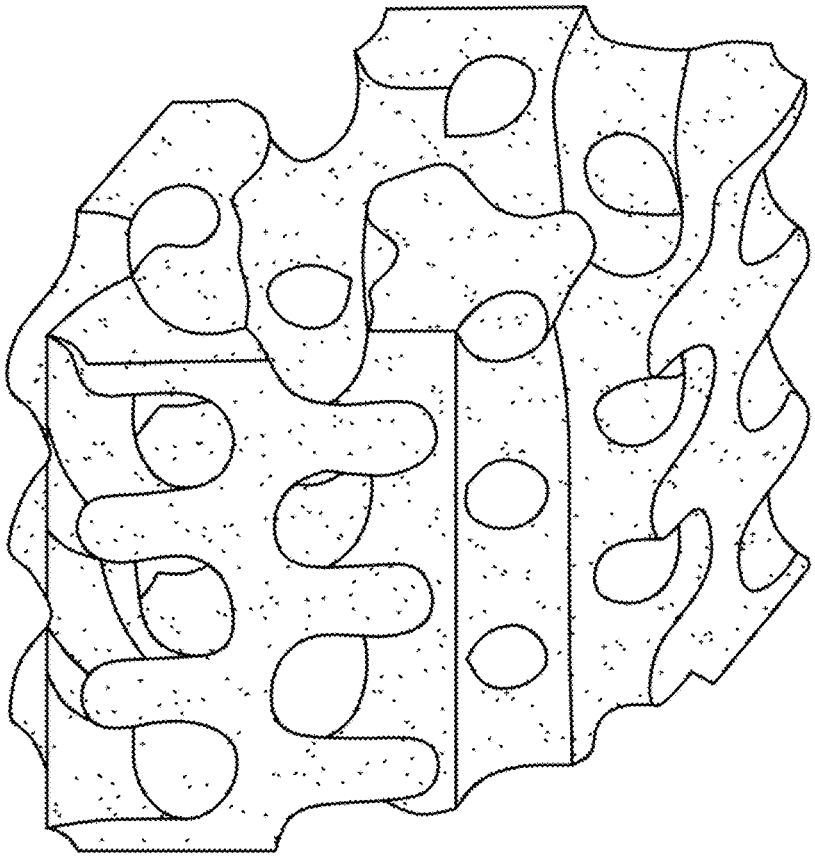
Figure 6C:
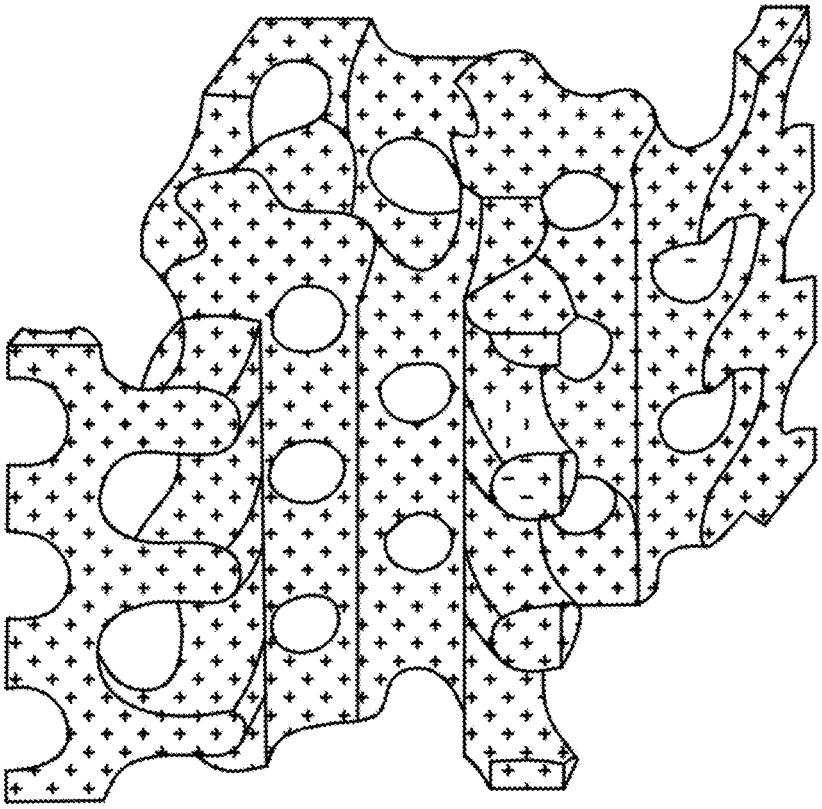
Figure 6D:
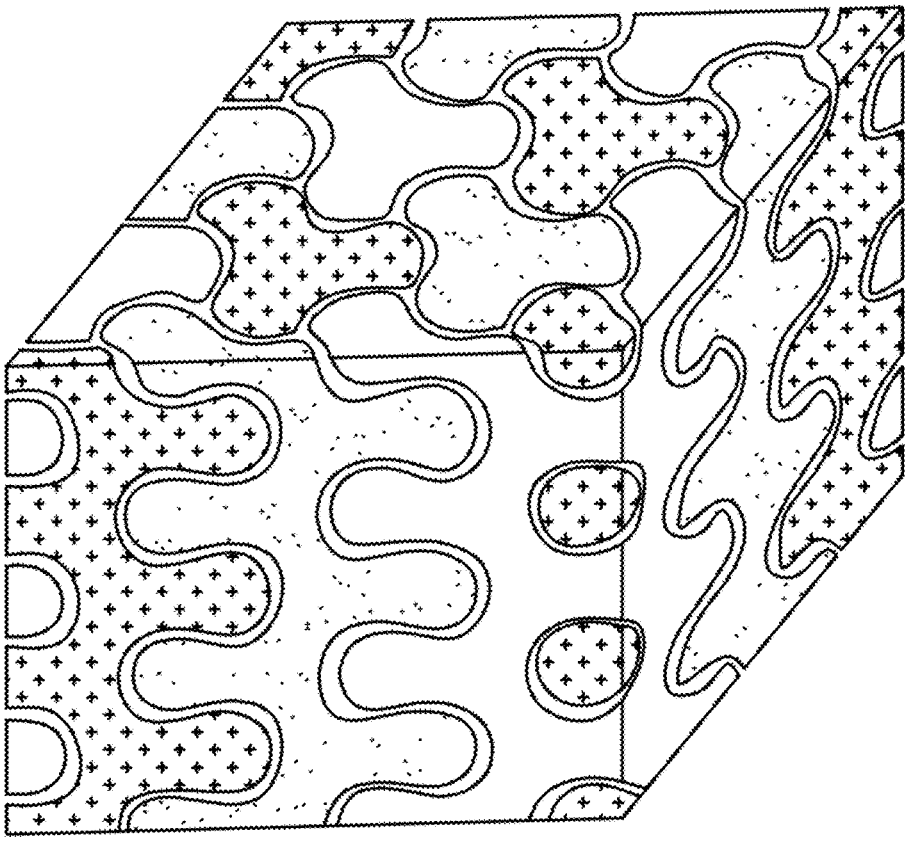
Figure 7A:
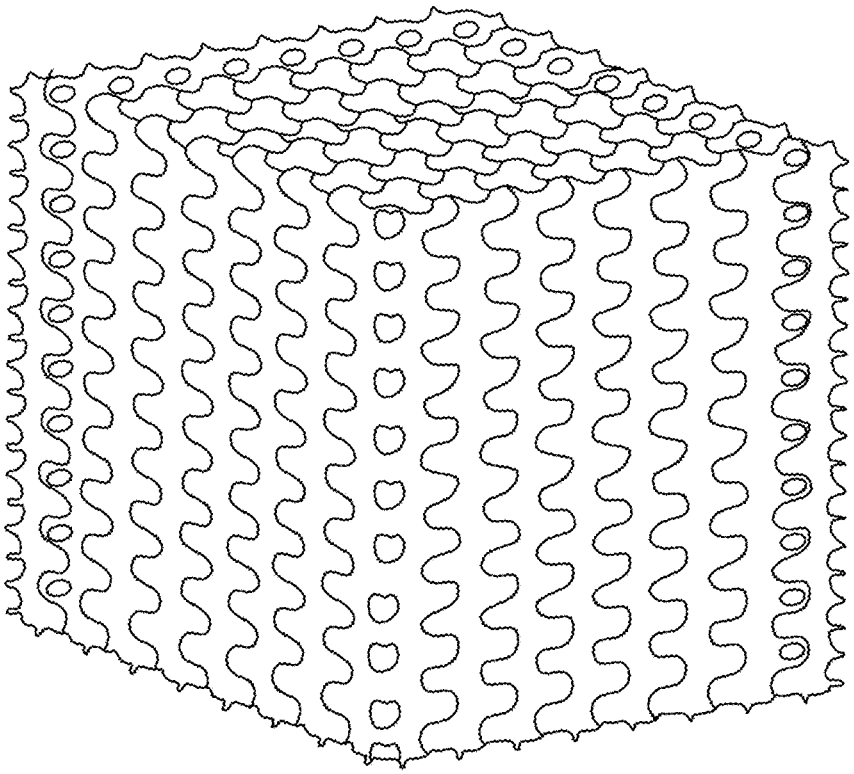
FIGS. 7A-7B are partial structural diagrams of the three-channel heat sink according to an embodiment of the present disclosure.
Figure 7B:
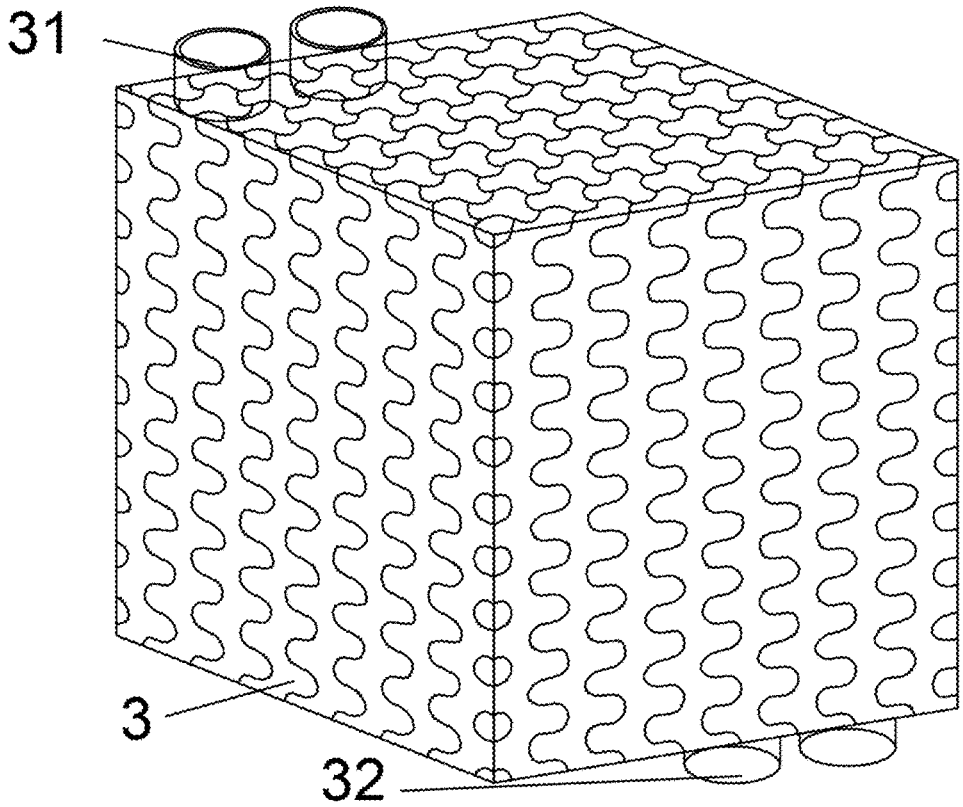

FIGS. 6A-6D show the partial morphology of different medium flow path units in a case that multiple heat dissipation layers are stacked, wherein FIG. 6A shows a stacking effect of multiple layers of first medium flow path units, FIG. 6B shows a stacking effect of multiple layers of second medium flow path units, FIG. 6C shows a stacking effect of multiple layers of third medium flow path units, and FIG. 6D shows a partial structure of a three-channel heat sink with three channels formed by combining the medium flow path units, where the three channels contact with each other. It is obvious from the figures that this structure is basically consistent with the schematic diagram of a flow path extracted from a microscopic structure shown in FIG. 2.

Figure 8:
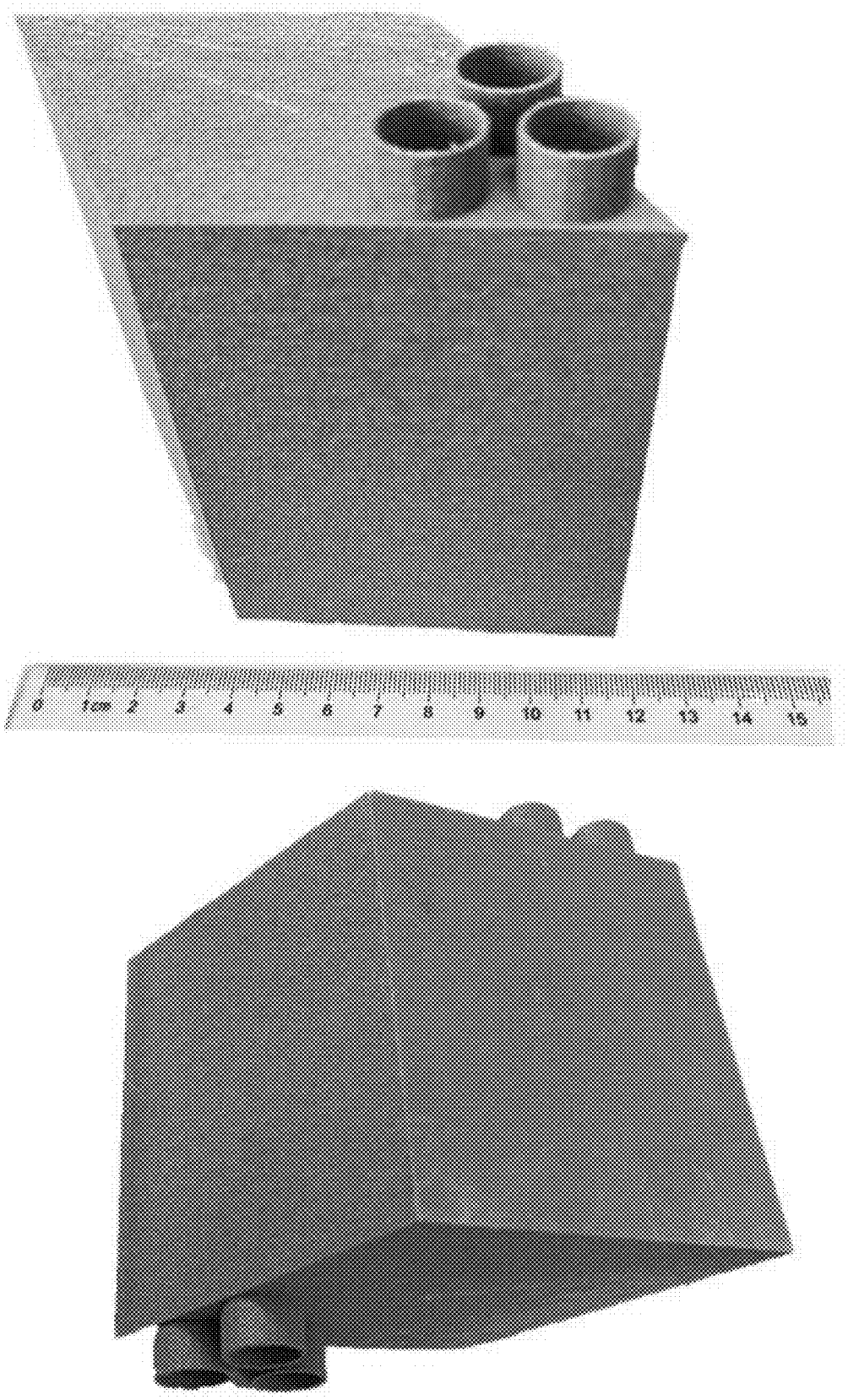
FIG. 8 is a diagram of a physical three-channel heat sink printed by a 3D printer according to an embodiment of the present disclosure.

As shown in FIG. 8, a heat sink housing 3 is arranged outside the three-channel heat sink, three medium inlets 31 and three medium outlets 32 are formed in the heat sink housing 3, and both ends of each of the first medium flow path, the second medium flow path and the third medium flow path are provided with one of the three medium inlets 31 and one of the three medium outlets 32, respectively.

Figure 4:
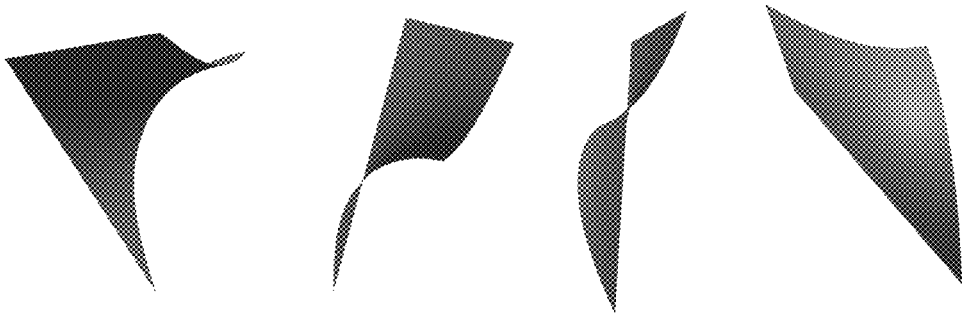
FIG. 4 is a three-dimensional structural schematic diagram of a minimum symmetric primitive configured for drawing of the three-channel porous unit according to an embodiment of the present disclosure.

As shown in FIG. 5, a preparation method for a three-channel heat sink based on a tri-continuous mesoporous silica structure is further provided by the present disclosure. The three-channel porous unit 1 is obtained by a minimum symmetric primitive through a plurality of steps, and FIG. 4 shows a three-dimensional structural diagram of the minimum symmetric primitive. The preparation method includes the following steps:

Step one, a minimum symmetric primitive is drawn in drawing software, and 180-degree rotation, circumferential array and mirror symmetry operations are carried out in sequence on the minimum symmetric primitive to obtain the three-channel porous unit 1;

Step two, three-channel porous units 1 in the drawing software are stacked to form a three-channel heat sink, where the three-channel heat sink is formed by stacking multiple three-channel porous units 1 in a three-dimensional space; and Step three, the three-channel heat sink is printed by a 3D printer.

The drawing software commonly used is CAD software, perfectly NX12 (Unigraphics NX12), Rhino, and Solidworks.

Three views of the processing process on the minimum symmetric primitive are shown in FIG. 5, and one three-channel porous unit 1 can be obtained by processing the minimum symmetric primitive, and schematic diagrams of the combination of the flow paths and the three-channel porous units 1 are shown in FIGS. 6A-6D.

Preferably, parameters of the three-channel porous unit 1 are as follows:

the size of the three-channel porous unit is 10 mm, the porosity of the three-channel porous unit is 80%, and a wall thickness of the three-channel porous unit is 0.66 mm.

Parameters of the stacked three-channel heat sink are as follows:

the whole size the stacked three-channel heat sink without the heat sink housing 3 is 80×80×100 $mm^3$.

The 3D printer is EOS M400-4 printer with the adopted technological parameters shown in the following table 1:

TABLE 1

| Laser diameter d (mm) | Laser power p (W) | Scanning speed v (mm/s) | Track spacing A (μm) | Layer thickness t (μm) |
|---|---|---|---|---|
| 55 μm | 90 | 700 | 105 | 25 |
| Scanning strategy | Substrate material | Disc diameter (mm) | Powder bed (mm) | Oxygen content |
| 67-degree rotation | Stainless steel | 0.15 | 100 mm (diameter) × 100 mm (height) | <100 ppm |

Figure 9:
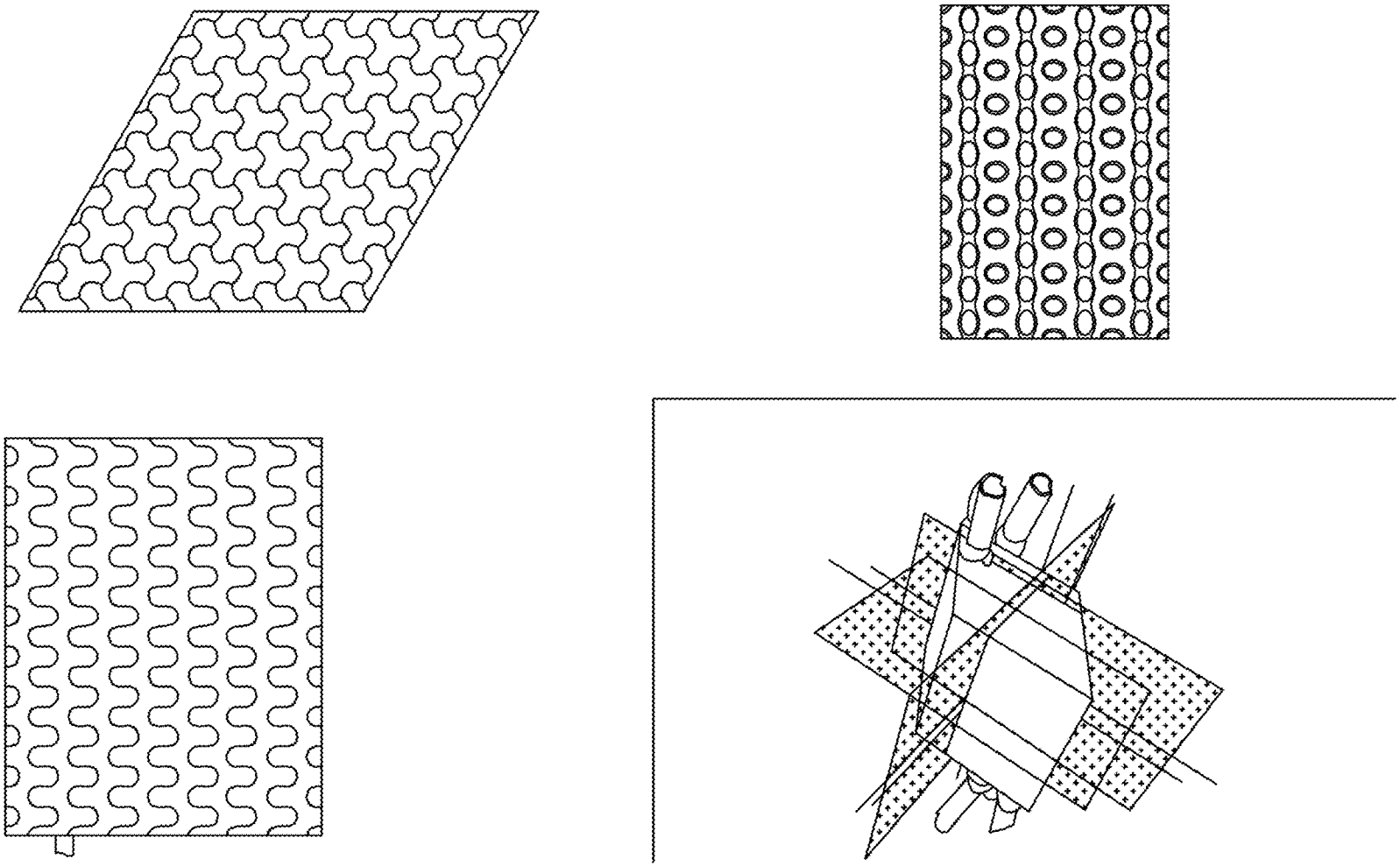
FIG. 9 is a CT scanning result of the physical three-channel heat sink according to an embodiment of the present disclosure.

A finished product printed by the 3D printer is as shown in FIG. 8. After 3D printing is finished, the obtained three-channel heat sink needs to be evaluated. The three-channel heat sink is characterized by CT. The model of CT equipment used is industrial CT (XT H450, Nikon Metrology Inc.) with the parameters shown in the following table 2. According to the CT scanning result shown in FIG. 9, the three-channel metamaterial heat sink has uniform wall thickness, compact processing and few defects.

TABLE 2

| Voltage | Current | Exposure time | Number of collected pictures | Resolution | Magnification times | Number of superimposed pictures |
|---|---|---|---|---|---|---|
| 200 kV | 115 μA | 1000 ms | 3141 | 87.1996 μm | 2.294 | 1 |

In order to better understand the working principle of the three-channel heat sink and evaluate the heat exchange performance thereof, a simulation model of the three-channel heat sink is constructed for simulation calculation, and a physical verification is also carried out.

By adopting CFD (Computational Fluid Dynamics) simulation analysis, based on Simcenter STAR CCM+2021 which can provide a module of "conjugate heat exchange and single-phase flow", the heat exchange and fluid flow characteristics of the structure are calculated. When the model is established, an incompressible fluid model with constant density and viscosity is adopted, following the Navier-Stokes equation. A RNG k-F turbulence model is selected as a turbulence model, and stimulation steady-state assumption is as follows:

(1) fluid is Newtonian fluid;

(2) fluid is in a stable flowing state;

(3) the floating force caused by density difference is ignored;

(4) the thermal effect caused by viscous dissipation in flow is ignored; and (5) the heat dissipation by the heat exchanger to the environment is ignored.

When the model is established, a total of 27 TPMS (triply periodic minimal surface) infinitesimals in 3×3×3 is selected as calculation objects. A calculation domain includes a metal solid domain and fluid domains of two fluids. The material characteristics of aluminum are selected for the solid domain, and water is selected for the fluid domain. The above material characteristics are called from a built-in material library of STAR CCM+. In order to adapt to the complex TPMS curved surface structure, a free tetrahedron element is selected for the grid, and boundary conditions selected for simulation are consistent with the experiment.

Figure 10:
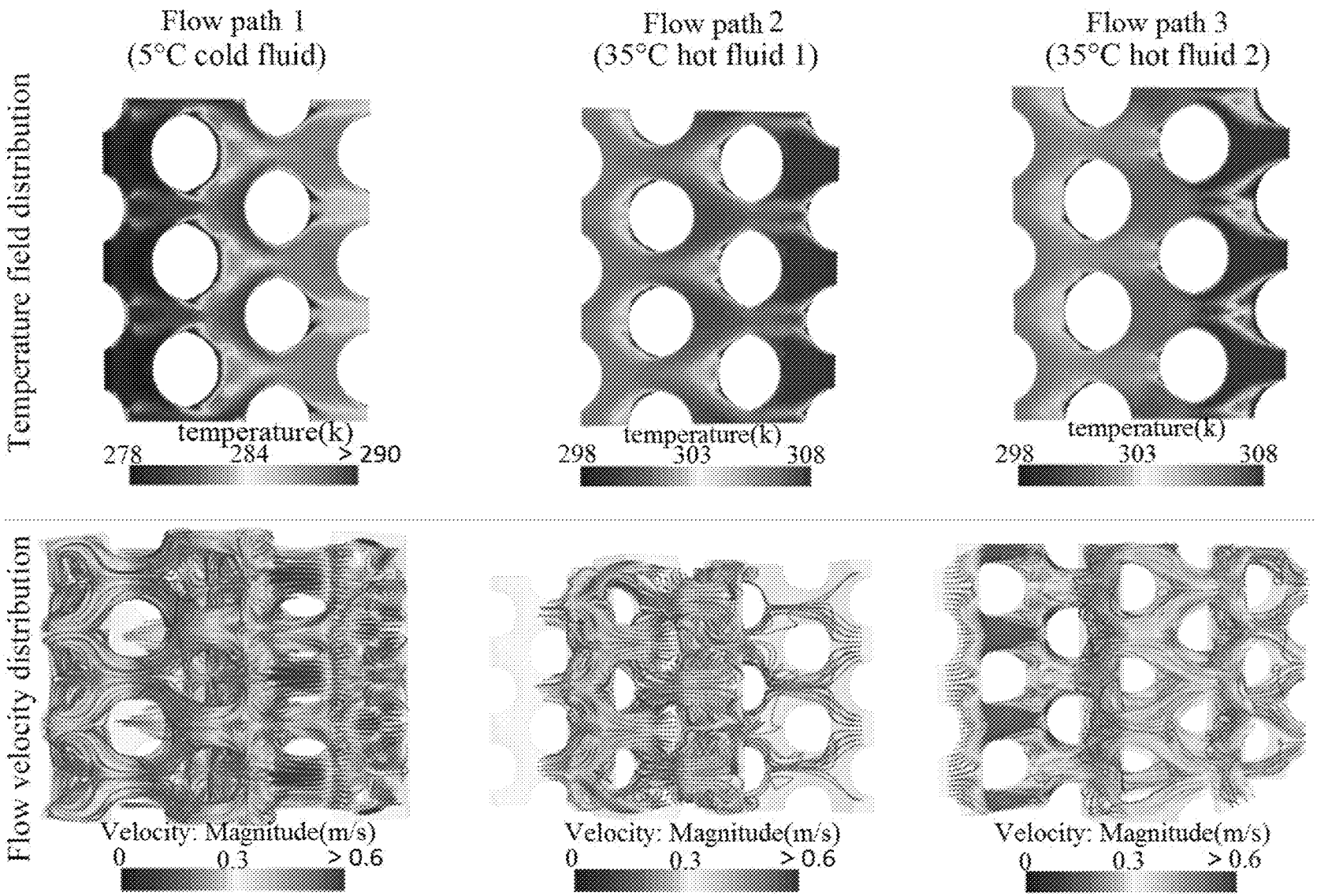
FIG. 10 is a simulation evaluation result according to an embodiment of the present disclosure.

Simulation results are as shown in FIG. 10 and the following table, two hot fluids with an inlet velocity of 0.1 m/s and an inlet temperature of 35° C. flow through an internal structure of TPMS, and then are cooled by a cold fluid with an inlet velocity of 0.1 m/s and an inlet temperature of 5° C. The two hot fluids have outlet temperature of 28.8° C. and 29.1° C., respectively, corresponding heat exchange capacity of 265.9 W and 285.5 W, respectively, and pressure drop of 153.4 Pa and 367.7 Pa, respectively. At the same time, the cold fluid has the heat exchange capacity of 583.8 W, and the pressure drop is 322.6 W. The deviation of heat exchange capacity of the hot and cold fluids is 5.5%. The simulation results show that the TPMS three-fluid heat exchanger can complete the heat exchange among three fluids at the same time, with excellent heat exchange capacity and low flow resistance, and has considerable application prospects in the field of heat exchangers.

TABLE 3

| | Inlet temperature (° C.) | Inlet velocity (m/s) | Outlet temperature (° C.) | Temperature change (° C.) | Heat exchange capacity | Pressure drop (Pa) |
|---|---|---|---|---|---|---|
| Fluid 1 (hot) | 35 | 0.1 | 28.8 | −6.2 | 265.9 | 153.4 |
| Fluid 2 (hot) | 35 | 0.1 | 29.1 | −5.9 | 285.5 | 367.7 |
| Fluid 3 (cold) | 5 | 0.1 | 21.3 | +16.3 | 583.8 | 322.6 |

A verification system is built according to the standard test system of heat exchangers, as shown in FIG. 10, including a refrigerant loop, and two coolant loops. R134a (tetrafluoroethane) and ethylene glycol aqueous solution with a concentration of 50% are selected as a working medium. A refrigeration system mainly includes a compressor, a condenser, a throttle valve, and a TPMS heat exchanger. In addition, there are other devices such as an oil separator, and a gas-liquid separator. R134a enters into the oil separator through the compressor and is supercooled in the condenser, is adiabatically expanded in an expansion valve, then enters the TPMS heat exchanger for testing, and finally returns to the compressor after passing through the gas-liquid separator. The ethylene glycol aqueous solution, after being cooled by a refrigerant in the TPMS heat exchanger, re-enters into a storage tank for reheating. Before the experiment starts, the reliability and air tightness of the equipment and pipelines are thoroughly checked, and a thermocouple, a pressure sensor and a flowmeter are calibrated. In order to minimize the heat loss from the TPMS heat exchanger to the surrounding environment, a test portion is insulated. After the experiment started, the system is adjusted by changing the power of the compressor at a refrigerant side, the opening of the expansion valve, the temperature and flow velocity at a coolant side, so as to reach predetermined operating conditions. In normal conditions, the system takes about 30 minutes to reach a stable state. Then, a data acquisition unit is started, and all the measurement results are recorded within a period of time, and an average value of each parameter recorded in this interval is calculated.

Taking the compressor rotating speed as 4000 rpm and the standard heat exchanger test condition as an example, for 3 etc type TPMS heat exchanger (12 mm of three-channel porous unit), the refrigerant side can provide 5501.2 W of refrigeration capacity to distribute to two coolant paths, and when one of the coolant loops is closed, the refrigerant side can provide 5102.9 W of refrigeration capacity to one coolant path. When a refrigerant loop is closed and the temperature difference between the two coolant paths is kept at 20° C., the heat exchange capacity of the two coolant paths is 4685.7 W, with the maximum heat exchange capacity per unit volume of 6.04 W/cm$^3$. For 3 pcu type heat exchanger (12 mm of three-channel porous unit), the heat exchange capacity is 800-1000 W higher than that of the 3 etc type in three working modes, with the maximum heat exchange capacity per unit volume of 6.59 W/cm3, but the pressure drop is doubled at the same time. When the unit size of the 3 etc type TPMS heat exchanger is reduced to 10 mm, the heat exchange capacity per unit volume is increased to 9.50 W/cm$^3$, but the pressure drop is also increased at the same time. Three TPMS type three-fluid heat exchangers all have considerable heat exchange capacity in three working modes, and have additional advantages compared with traditional two-fluid heat exchangers. The experimental results are shown in the following table 4.

TABLE 4

| Refrigerant | Water 1 | Water 2 |
|---|---|---|
| 3etc type TPMS heat exchanger (12 mm three-channel porous unit) | | |
| 5501.2 W | 3028.3 W (35° C., 15 L/min) | 2346.6 W (35° C., 15 L/min) |
| 5102.9 W | / | 5061.5 W (35° C., 15 L/min) |
| / | 4654.9 W (10° C., 15 L/min) | 4685.7 W (35° C., 15 L/min) |
| 3pcu type heat exchanger (12 mm three-channel porous unit) | | |
| 6487.2 W | 2990.5 W (35° C., 15 L/min) | 3357.6 W (35° C., 15 L/min) |
| 6002.3 W | / | 5919.7 W (35° C., 15 L/min) |
| / | 5374.1 W (10° C., 15 L/min) | 5352.9 W (35° C., 15 L/min) |
| 3etc type TPMS heat exchanger (10 mm three-channel porous unit) | | |
| 5067.3 W | 2615.7 W (35° C., 15 L/min) | 1987.5 W (35° C., 15 L/min) |
| 5087.2 W | / | 4909.1 W (35° C., 15 L/min) |
| / | 4283.7 W (10° C., 15 L/min) | 4256 W (35° C., 15 L/min) |

Specific examples are used herein for illustration of the principles and implementation methods of the present disclosure. The description of the embodiments is merely used to help illustrate the method and its core principles of the present disclosure. In addition, a person of ordinary skill in the art can make various modifications in terms of specific embodiments and scope of application in accordance with the teachings of the present disclosure. In conclusion, the content of this specification shall not be construed as a limitation to the present disclosure.

What is claimed is:

1. A three-channel heat sink based on a tri-continuous mesoporous silica structure, comprising a plurality of three-channel porous units (1) stacked on one another, wherein each of the three-channel porous units (1) comprises a first channel (21), a second channel (22) and a third channel (23) which do not communicate with one another, wherein each of the first channel (21), the second channel (22) and the third channel (23) comprises at least one flow path (11), wherein the flow path (11) comprises an upper horizontal section (111), a vertical section (112), and a lower horizontal section (113); and wherein an outlet end of the upper horizontal section (111) is connected to an inlet end of the vertical section (112), an outlet end of the vertical section (112) is connected to an inlet end of the lower horizontal section (113), and the upper horizontal section (111), the vertical section (112) and the lower horizontal section (113) form a Z-shaped structure;

wherein each of the three-channel porous units (1) comprises five flow paths (11), wherein the five flow paths are arranged in two layers in a vertical direction, and wherein the upper horizontal section (111) and the lower horizontal section (113) of each of the five flow paths (11) are located in an upper layer and a lower layer in the vertical direction, respectively;

wherein, when viewed in the vertical direction, four of the five flow paths (11) are enclosed to form a parallelogram pattern, wherein, in the upper layer, upper horizontal sections (111) of two adjacent flow paths (11) intersect and communicate with each other to form the first channel (21) and in the lower layer, lower horizontal sections (113) of the two adjacent flow paths (11) intersect and communicate with each other to form the second channel (22); and wherein a remaining one of the five flow paths (11) is located at a diagonal position of the parallelogram pattern to independently form the third channel (23); and wherein a body formed by the three-channel porous units (1) stacked on one another is internally provided with three medium flow paths that intersect, contact, and do not communicate with one another.

2. The three-channel heat sink based on a tri-continuous mesoporous silica structure according to claim 1, wherein, in a same layer in the vertical direction, the three-channel porous units (1) are sequentially aligned and arranged to form a heat dissipation layer and wherein adjacent three-channel porous units (1) share one flow path.

3. The three-channel heat sink based on a tri-continuous mesoporous silica structure according to claim 2, wherein in a same horizontal plane, a joint where upper horizontal sections (111) of one of the three-channel porous units (1) intersect and communicate with one another is externally connected with an outlet end of the third channel (23) of an other of the three-channel porous units (1).

4. The three-channel heat sink based on a tri-continuous mesoporous silica structure according to claim 3, wherein in a same horizontal plane, a joint where lower horizontal sections (113) of one of the three-channel porous units (1) intersect and communicate with one another is externally connected with an inlet end of the third channel (23) of another of the three-channel porous units (1).

5. The three-channel heat sink based on a tri-continuous mesoporous silica structure according to claim 4, wherein, in a same layer in the vertical direction, second channels (22), third channels (23) and first channels (21) of three of the three-channel porous units (1) are sequentially connected to form a first medium flow path unit and wherein a plurality of first medium flow path units are in communication with one another to form a first medium flow path.

6. The three-channel heat sink based on a tri-continuous mesoporous silica structure according to claim 4, wherein, in a same layer in the vertical direction, first channels (21), third channels (23) and second channels (22) of three of the three-channel porous units (1) are sequentially connected to form a second medium flow path unit and wherein a plurality of second medium flow path units are in communication with one another to form a second medium flow path.

7. The three-channel heat sink based on a tri-continuous mesoporous silica structure according to claim 4, wherein, in a same layer in the vertical direction, third channels (23) of three of the three-channel porous units (1) are respectively connected to first channels (21) or second channels (22) of the three of the three-channel porous units (1) in sequence to form a third medium flow path unit and wherein a plurality of third medium flow path units are in communication with one another to form a third medium flow path.

8. The three-channel heat sink based on a tri-continuous mesoporous silica structure according to claim 2, wherein a plurality of heat dissipation layers are stacked in the vertical direction to form the three-channel heat sink, vertical sections (112) corresponding to positions between adjacent heat dissipation layers communicate with each other, and the three-channel heat sink is of a hexahedral structure.

9. The three-channel heat sink based on a tri-continuous mesoporous silica structure according to claim 8, wherein a heat sink housing (3) is arranged outside the three-channel heat sink, three medium inlets (31) and three medium outlets (32) are formed in the heat sink housing (3), and both ends of each of the first medium flow path, the second medium flow path and the third medium flow path are provided with one of the three medium inlets (31) and one of the three medium outlets (32), respectively.

* * * * *